US011590384B2

(12) United States Patent
Hurlbut

(10) Patent No.: US 11,590,384 B2
(45) Date of Patent: Feb. 28, 2023

(54) ELASTIC EXERCISE DEVICE AND METHOD OF USING

(71) Applicant: GH Product Design and Devlopment, LLC, Seattle, WA (US)

(72) Inventor: Gary Hurlbut, Bellingham, WA (US)

(73) Assignee: GH PRODUCT DESIGN AND DEVELOPMENT, LLC, Seattle, WA (US)

( * ) Notice: Subject to any disclaimer, the term of this patent is extended or adjusted under 35 U.S.C. 154(b) by 516 days.

(21) Appl. No.: 16/301,122

(22) PCT Filed: May 2, 2017

(86) PCT No.: PCT/US2017/030677

§ 371 (c)(1),
(2) Date: Nov. 13, 2018

(87) PCT Pub. No.: WO2017/200743

PCT Pub. Date: Nov. 23, 2017

(65) Prior Publication Data

US 2020/0316427 A1 Oct. 8, 2020

Related U.S. Application Data

(63) Continuation-in-part of application No. 15/157,091, filed on May 17, 2016, now Pat. No. 9,713,734.

(51) Int. Cl.

| | |
|---|---|
| ***A63B 21/00*** | (2006.01) |
| ***A63B 21/04*** | (2006.01) |
| ***A63B 23/12*** | (2006.01) |
| ***A63B 23/035*** | (2006.01) |
| ***A63B 23/04*** | (2006.01) |

(52) U.S. Cl.
CPC .... *A63B 21/4035* (2015.10); *A63B 21/00069* (2013.01); *A63B 21/0414* (2013.01); *A63B 23/03508* (2013.01); *A63B 23/03516* (2013.01); *A63B 23/04* (2013.01); *A63B 23/1209* (2013.01)

(58) Field of Classification Search
CPC ..... A63B 21/4035; A63B 21/00069; A63B 21/0414; A63B 23/03508; A63B 23/03516; A63B 23/04; A63B 23/1209; A63B 21/0722; A63B 21/0726; A63B 21/154;

(Continued)

(56) References Cited

U.S. PATENT DOCUMENTS 4,059,265 A 11/1977 Wieder et al.
D261,788 S * 11/1981 Burns ..... D21/682

(Continued)

FOREIGN PATENT DOCUMENTS

DE 102 42 287 A1 3/2004

*Primary Examiner* — Andrew S Lo
(74) *Attorney, Agent, or Firm* — Seed Intellectual Property Law Group LLP

(57) ABSTRACT

In one embodiment a fitness device is disclosed. The fitness device may include a central handle having a body with a central aperture through the body. The device may also include a first rod removably coupled to the central handle at a first location and a second rod removably coupled to the central handle at a second location, opposite the first location. The device may also include an elastic member having a first end and a second end, the first end being coupled to the first rod and the second end being coupled to the second rod.

6 Claims, 10 Drawing Sheets

(58) Field of Classification Search
CPC ..... A63B 2071/027; A63B 21/072; A63B 21/0552
See application file for complete search history.

(56) References Cited

U.S. PATENT DOCUMENTS

| | | | | |
|---|---|---|---|---|
| 4,690,400 | A * | 9/1987 | Metz | A63B 21/00069 482/106 |
| 4,822,035 | A * | 4/1989 | Jennings | A63B 21/0724 482/106 |
| RE33,218 | E * | 5/1990 | Twardosz | A63B 21/0724 482/106 |
| 5,024,434 | A * | 6/1991 | Smith | A63B 21/0728 482/106 |
| 5,334,113 | A * | 8/1994 | Roepke | A63B 21/4001 482/106 |
| 5,407,405 | A * | 4/1995 | Oren | A63B 7/02 482/106 |
| 5,549,532 | A | 8/1996 | Kropp | |
| D390,615 | S * | 2/1998 | Stutsman | D21/681 |
| 5,718,654 | A * | 2/1998 | Kennedy | A63B 21/4035 482/102 |
| 5,746,687 | A | 5/1998 | Vial et al. | |
| 5,885,196 | A | 3/1999 | Gvoich | |
| 6,022,300 | A * | 2/2000 | Hightower | A63B 21/0728 482/106 |
| 6,648,804 | B2 * | 11/2003 | Chen | A63B 21/0004 482/125 |
| 7,041,041 | B1 | 5/2006 | Evans | |
| D535,336 | S * | 1/2007 | Diakonov | D21/679 |
| 7,326,157 | B2 | 2/2008 | Wu | |
| 7,465,259 | B2 * | 12/2008 | Mok | A63B 21/00185 482/121 |
| 7,862,486 | B1 * | 1/2011 | Watson | A63B 21/0724 482/106 |
| 7,922,634 | B1 | 4/2011 | Wu | |
| 7,955,157 | B1 * | 6/2011 | Hedeen, Jr. | A63B 67/08 446/236 |
| 7,958,881 | B2 | 6/2011 | Silverson | |
| 8,079,942 | B2 | 12/2011 | Anderson | |
| D671,996 | S * | 12/2012 | Wierszewski | D21/680 |
| 8,556,781 | B1 | 10/2013 | Fitzpatrick | |
| 8,672,815 | B1 * | 3/2014 | Springer | A63B 21/0724 482/106 |
| 9,254,408 | B1 | 2/2016 | Otto | |
| D763,166 | S * | 8/2016 | Berson | D12/215 |
| D776,209 | S * | 1/2017 | Gilbert | D21/683 |
| 9,713,734 | B1 * | 7/2017 | Hurlbut | A63B 21/05 |
| D797,217 | S * | 9/2017 | Gilbert | D21/681 |
| 10,029,140 | B2 * | 7/2018 | Douglass | A63B 21/4049 |
| 10,065,063 | B1 * | 9/2018 | Hurlbut | A63B 21/4035 |
| 10,695,604 | B2 * | 6/2020 | Porterfield | A63B 21/4049 |
| 10,960,254 | B2 * | 3/2021 | Hurlbut | A63B 23/03508 |
| 11,000,725 | B2 * | 5/2021 | Light | A63B 21/4049 |
| 2005/0037904 | A1 | 2/2005 | Chang et al. | |
| 2005/0239617 | A1 * | 10/2005 | Tenaglia | A63B 21/0552 482/904 |
| 2008/0287272 | A1 | 11/2008 | Luckadue | |
| 2010/0152002 | A1 | 6/2010 | Knight | |
| 2011/0301000 | A1 | 12/2011 | Pullen | |
| 2012/0094812 | A1 | 4/2012 | Smiley | |
| 2013/0035218 | A1 * | 2/2013 | Wierszewski | A63B 21/072 482/106 |
| 2013/0340735 | A1 * | 12/2013 | Emory | F41B 5/1403 124/88 |
| 2014/0038793 | A1 | 2/2014 | Hetzel | |
| 2014/0366858 | A1 | 12/2014 | Garver et al. | |
| 2016/0074692 | A1 | 3/2016 | Vial | |
| 2020/0030656 | A1 * | 1/2020 | Hurlbut | A63B 23/03508 |
| 2020/0316427 | A1 * | 10/2020 | Hurlbut | A63B 23/03516 |

* cited by examiner

ELASTIC EXERCISE DEVICE AND METHOD OF USING

BACKGROUND

Technical Field

This disclosure generally relates to exercise equipment and, more particularly, to elastic exercise devices.

Description of the Related Art

Maintaining good physical fitness and range of motion is difficult for many people. They may be intimidated by gyms and the large bulky exercise equipment usually associated with gyms or they may find it difficult to make the time to travel to the gym for a workout. Some people travel often and despite good fitness habits at home, the stress of travel and the lack of suitable equipment in many hotels can cause people to skip workouts. Still other people may lack the strength to lift some of the heavier workout equipment or a doctor or trainer may recommend only light resistance workouts.

While many devices exist that may fulfil some exercise needs, they are often single task devices suitable for a few select workouts or provide only a few select resistances. They lack greater adjustability and suitability for multiple exercises at multiple resistances.

BRIEF SUMMARY

In one embodiment a fitness device is disclosed. The fitness device may include a central handle having a body with a central aperture through the body. The device may also include a first rod removably coupled to the central handle at a first location and a second rod removably coupled to the central handle at a second location, opposite the first location. The device may also include an elastic member having a first end and a second end, the first end being coupled to the first rod and the second end being coupled to the second rod.

The fitness device may further include a first coupling that couples the first rod to the central handle and a second coupling that couples the second rod to the central handle. The first and second couplings may be collets. The fitness device may further include a first resistance adjuster coupled to the first rod and a second resistance adjuster coupled to the second rod, the elastic member passing through the first and second resistance adjusters, the first and second resistance adjusters being configured to slide along a respective length of the first and second rods.

The fitness device may further include a first handle positionable along a length of the first rod and a second handle positionable along a length of the second rod. The fitness device may further include a first resistance adjuster coupled to the first handle and a second resistance adjuster coupled to the second handle, the elastic member passing through the first and second resistance adjusters. The first and second handles may each include a collet configured to engage with a respective one of the first and second rods and configured to resist movement of the first and second handles along the respective lengths of the first and second rods.

In another embodiment a fitness device may include a central handle including a first handle member extending between a first coupling and a second coupling and a second handle member extending between the first coupling and the second coupling, the first and second handle members forming at least a portion of a central aperture through the central handle. The fitness device may also include a first rod removably coupled to the central handle at a first location and a second rod removably coupled to the central handle at a second location, opposite the first location. The device may also include an elastic member having a first end and a second end, the first end being coupled to the first rod and the second end being coupled to the second rod.

The fitness device may further include a first handle including a body having a channel formed along a length of the body, the first handle being positionable along a length of the first rod, and a second handle including a body having a channel formed along a length of the body, the second handle being positionable along a length of the second rod. The fitness device may further include a first handle positionable along a length of the first rod and a second handle positionable along a length of the second rod. The fitness device may further include a first resistance adjuster coupled to the first rod and a second resistance adjuster coupled to the second rod, the elastic member passing through the first and second resistance adjusters, the first and second resistance adjusters being configured to slide along a respective length of the first and second rods.

The fitness device may further include a first handle positionable along a length of the first rod, the first resistance adjuster being integral with the first handle, and a second handle positionable along a length of the second rod, the second resistance adjuster being integral with the second handle. The fitness device may further include at least one interchangeable weight configured to be removably coupled to the central handle.

In yet another embodiment, a fitness device may include a central handle, a first rod coupled to the central handle, and a second rod coupled to the central handle. The fitness device may also include an elastic member having a first end and a second end, the first end being coupled to the first rod and the second end being coupled to the second rod. The device may also include a first resistance adjuster coupled to the first rod and a second resistance adjuster coupled to the second rod. The elastic member may pass through the first and second resistance adjusters.

The fitness device may further include a first handle positionable along a length of the first rod and a second handle positionable along a length of the second rod. The fitness device may further include at least one interchangeable weight configured to be removably coupled to the central handle. The first resistance adjuster may be integral with the first handle and the second resistance adjuster may be integral with the second handle. The first rod may be removably coupled to the central handle and the second rod may be removably coupled to the central handle.

The first and second resistance adjusters may each include a clamp configured to be releasably engaged with a respective one of the first and second rods and resist movement of the respective adjuster along the length of the respective rods. The fitness device may further include a first aperture through the first handle and a second aperture through the second handle, the elastic member passing through the first aperture and the second aperture.

In another embodiment, a method of using an exercise device comprises: holding a ring-shaped handle of the exercise device in a first hand; holding an elastic member of the exercise device in a second hand; pulling the elastic member away from the ring-shaped handle against a resistance of the elastic member; coupling one or more plate weights to the ring-shaped handle; and lifting the ring-shaped handle and the one or more plate weights.

During the pulling of the elastic member away from the ring-shaped handle, the exercise device may include a first rod, a proximal end of the first rod coupled to the ring-shaped handle at a first coupling at a first location, and a second rod, a proximal end of the second rod coupled to the ring-shaped handle at a second coupling at a second location opposite to the first location across a diameter of the ring-shaped handle. During the pulling of the elastic member away from the ring-shaped handle, a first end of the elastic member may be coupled to a distal end of the first rod and a second end of the elastic member may be coupled to a distal end of the second rod. During the pulling of the elastic member away from the ring-shaped handle, the exercise device may include a first adjustable handle adjustably coupled to the first rod, wherein adjusting the position of the first adjustable handle along a length of the first rod changes the resistance of the elastic member.

During the pulling of the elastic member away from the ring-shaped handle, the exercise device may include a second adjustable handle adjustably coupled to the second rod, wherein adjusting the position of the second adjustable handle along a length of the second rod changes the resistance of the elastic member. The method may further comprise, after pulling the elastic member and before coupling one or more plate weights to the ring-shaped handle, removing the first rod and the second rod from the first and second couplings and from the ring-shaped handle. Coupling one or more plate weights to the ring-shaped handle may comprise, after removing the first rod and the second rod from the first and second couplings, coupling the one or more plate weights to the first and second couplings.

In another embodiment, an exercise device comprises: a ring-shaped handle including an opening extending through a center of the ring-shaped handle, a first coupling at a first location, the first coupling having a first cylindrical outer surface with a first outer diameter of about 5 cm, and a second coupling at a second location opposite to the first location across a diameter of the ring-shaped handle, the second coupling having a second cylindrical outer surface with a second outer diameter of about 5 cm; a first rod, a proximal end of the first rod removably coupled to the ring-shaped handle at the first coupling; a second rod, a proximal end of the second rod removably coupled to the ring-shaped handle at the second coupling; and an elastic member, a first end of the elastic member coupled to a distal end of the first rod, and a second end of the elastic member coupled to a distal end of the second rod.

The exercise device may further comprise a first adjustable handle adjustably coupled to the first rod, wherein adjusting a position of the first adjustable handle along a length of the first rod changes a resistance of the elastic member to being pulled away from the ring-shaped handle. The exercise device may further comprise a second adjustable handle adjustably coupled to the second rod, wherein adjusting a position of the second adjustable handle along a length of the second rod changes the resistance of the elastic member to being pulled away from the ring-shaped handle.

An exercise device may comprise a ring-shaped handle including an opening extending through a center of the ring-shaped handle, a first coupling at a first location, and a second coupling at a second location opposite to the first location across a diameter of the ring-shaped handle; an elastic member; a first rod, a proximal end of the first rod coupled to the first coupling, a distal end of the first rod coupled to a first end of the elastic member; a second rod, a proximal end of the second rod coupled to the second coupling, a distal end of the second rod coupled to a second end of the elastic member; a first adjustable handle adjustably coupled to the first rod, wherein adjusting a position of the first adjustable handle along a length of the first rod changes a resistance of the elastic member to being pulled away from the ring-shaped handle, the first adjustable handle including a first cam lock to lock the first adjustable handle to the first rod; and a second adjustable handle adjustably coupled to the second rod, wherein adjusting a position of the second adjustable handle along a length of the second rod changes the resistance of the elastic member to being pulled away from the ring-shaped handle, the second adjustable handle including a second cam lock to lock the second adjustable handle to the second rod.

The first coupling may have a first cylindrical outer surface with a first outer diameter of about 5 cm and the second coupling may have a second cylindrical outer surface with a second outer diameter of about 5 cm. The first adjustable handle may include a first shackle and the elastic member may extend through the first shackle, and the second adjustable handle may include a second shackle and the elastic member may extend through the second shackle. The first rod may have a first central longitudinal axis, the second rod may have a second central longitudinal axis coincident with the first central longitudinal axis, and the opening extending through the center of the ring-shaped handle may have a third central longitudinal axis that is perpendicular to the first and second central longitudinal axes. The first and second couplings may be first and second collet couplings.

The first adjustable handle may include: a hollow cylindrical body having a side wall with a circumferential opening adjacent to a proximal end of the first adjustable handle; and a clip rotatably mounted within the circumferential opening so that the clip can be rotated inward toward the hollow cylindrical body to engage the first cam lock and outward away from the hollow cylindrical body to disengage the first cam lock. A first circumferential end of the circumferential opening may include a first bearing for rotatably mounting the clip to the hollow cylindrical body and a second circumferential end of the circumferential opening opposite to the first circumferential end may include a partial wall that extends from an inner surface of the hollow cylindrical body partially outward through the thickness of the hollow cylindrical body. A first end of the clip may include a second bearing for engaging with the first bearing, and the first end of the clip may have an outer profile that forms a cam surface of the cam lock.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with the technology have not been shown or described in detail to avoid unnecessarily obscuring descriptions of the embodiments.

Figure 1:
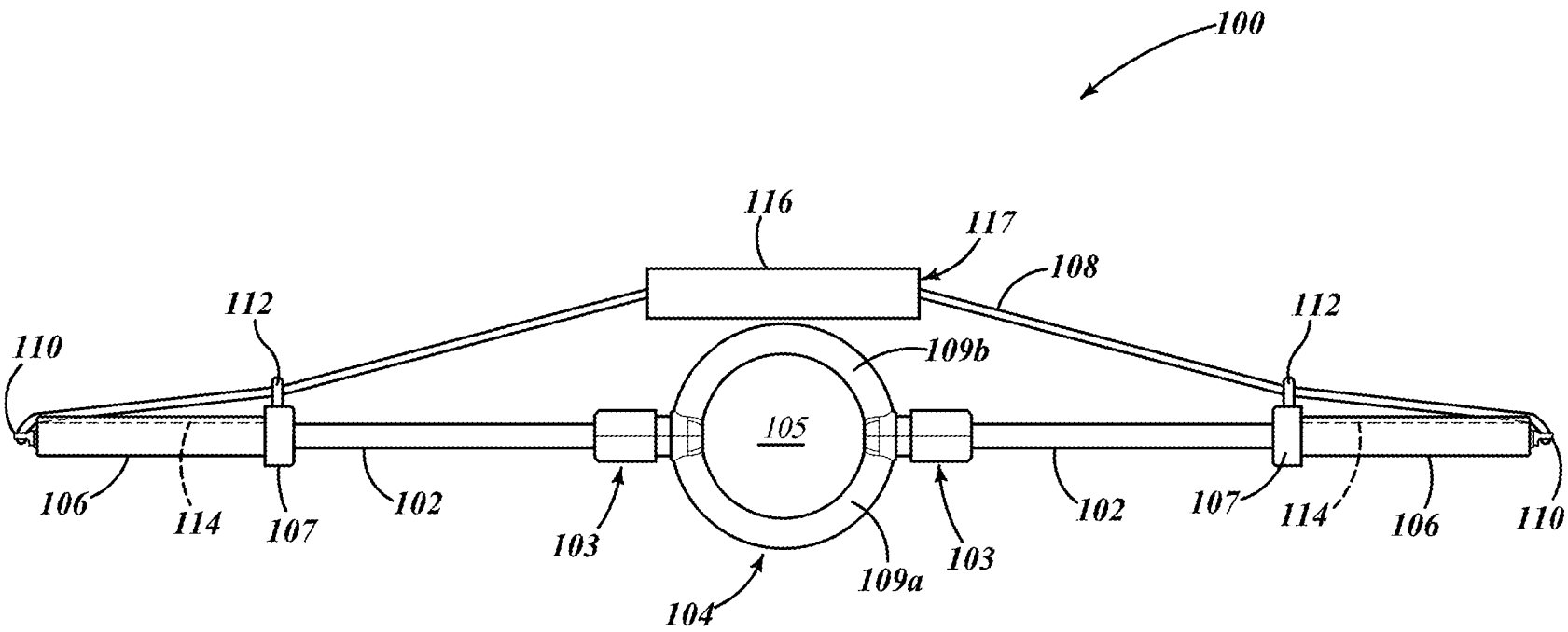
FIG. 1 depicts an elastic resistance device according to one or more embodiments disclosed herein.

FIG. 1 shows an elastic fitness device 100 including two rods 102 that extend from, and are coupled to, a central handle 104 and an elastic member 108 that is coupled to the respective ends of each rod 102. The rods 102 are coupled to the central handle 104 via couplings 103, which may be collets or another type of coupling. The rods 102 are equal length and may be made from one or more materials, such as aluminum, carbon, carbon fiber, plastic, wood, composite materials, or other materials. In some embodiments, the rods 102 may be multi-piece rods or, as depicted in FIG. 1, each rod 102 may be a single unitary member.

The couplings 103 allow the elastic fitness device 100 to be taken apart for storage and travel.

The body of the central handle 104 depicted in FIG. 1 has two handle members 109*a*, 109*b* that extend opposite each other and between the couplings 103. The two handle members 109*a*, 109*b* provide strength and stiffness to the elastic fitness device 100 as compared to a device that includes a central handle having only a single member. During use, the two handle members 109*a*, 109*b*, spread the forces imparted on the device between both handle members 109*a*, 109*b* with one handle member 109*a*, 109*b* in compression while the other handle member 109*a*, 109*b* is in tension.

The central handle 104 has an annular, circular shape with a central aperture 105. In other embodiments, the central handle 104 may have a square or rectangular shape with a central aperture.

The elastic member 108 may be an elastic cord, such as surgical tubing, shock cord (an elastic cord including one or more elastic strands forming a core that may be covered in a woven sheath), or other elastic material. Each end of the elastic member 108 is coupled to a respective end of the rods 102 of the elastic fitness device 100. The ends of the rods 102 may include a coupling 110, which may be, for example, a ring or eyelet through with the elastic member 108 is tied. In some embodiments, the elastic member 108 may be coupled to the end of the rods or to the coupling 110 via other couplers, such as clips or carabiners.

The elastic fitness device 100 may also include a handle 116 on the elastic member 108. The handle 116 may include a central aperture 117 through which the elastic member 108 passes. The elastic member 108 may have a relatively small diameter. For example, the elastic member 108 may have diameter between ⅛ and ½ inch. If a user were to directly grip the elastic member during a workout, then such small diameters may cause discomfort or fatigue to a user during even relatively short workouts. The handle 116 has a diameter that is greater than the diameter of the elastic member 108. The handle 116 provides additional padding between the elastic member 108 and the user's hand and increases the gripping surface area for the user. The increased surface area distributes the forces associated with using the elastic fitness device 100 over a greater area and can reduce discomfort and fatigue in a user's hands. The handle 116 can have various lengths and can be longer or shorter than as illustrated in FIG. 1. In some implementations, the handle 116 can be curved, rather than straight as illustrated in FIG. 1, such as to match a curvature of the handle member 109*b*.

The elastic fitness device 100 also includes a handle 106 on each rod 102. The handles 106 may be padded such that they provide a more comfortable and higher friction gripping surface as compared to the rods 102, which may have a smooth or bare exterior surface. The handles 106 are positionable along the length of each respective rod 102 such that they may be positioned at one or more locations between the end of a respective rod 102 and the coupling 103 that couples each rod 102 to the central handle 104.

The handles 106 include a lock 107 that fixes the handle to the rod 102 at a particular or desired location. For example, during some exercises a user may be directed to space the handles 106 far apart in order to exercise a certain set of muscles, while during other exercises the handles 106 may be placed closer together in order to exercise a different set of muscles.

The handles 106 shown in FIG. 1 include an integral resistance adjuster 112. The resistance adjuster 112 is used to adjust the resistance provided by the elastic member 108. For example, when the resistance adjusters 112 are placed far apart, as shown in FIG. 1, the elastic member 108 provides relatively low resistance. When the resistance adjusters 112 are placed closer together the elastic member 108 provides a relatively high resistance.

The difference in resistance provided by the same elastic member 108 is caused by the change in the path length along the elastic member 108 for a given amount of pull. For example when the resistance adjusters 112 are at a position at, or very near, the central handle 104, when a user pulls the handle 116 a distance of twelve inches from a rest position, then the elastic member stretches approximately 24 inches.

For a similar 36 inch elastic fitness device, when the elastic member is affixed at the ends of the rods 102, but not routed through the resistance adjusters 112, then pulling the handle 116 twelve inches from a rest position only stretches the elastic member approximately 21½ inches.

The handles 106 also include a channel 114. The elastic member 108 may be routed through some or all of the channel 114. For example, as shown in FIG. 1, a portion of the elastic member passes through the channel 114. The depth of the channel may be the same as or greater than the diameter of the elastic member 108. In some embodiments, the depth of the channel 114 may be less than the diameter of the elastic member 108.

Figure 2:
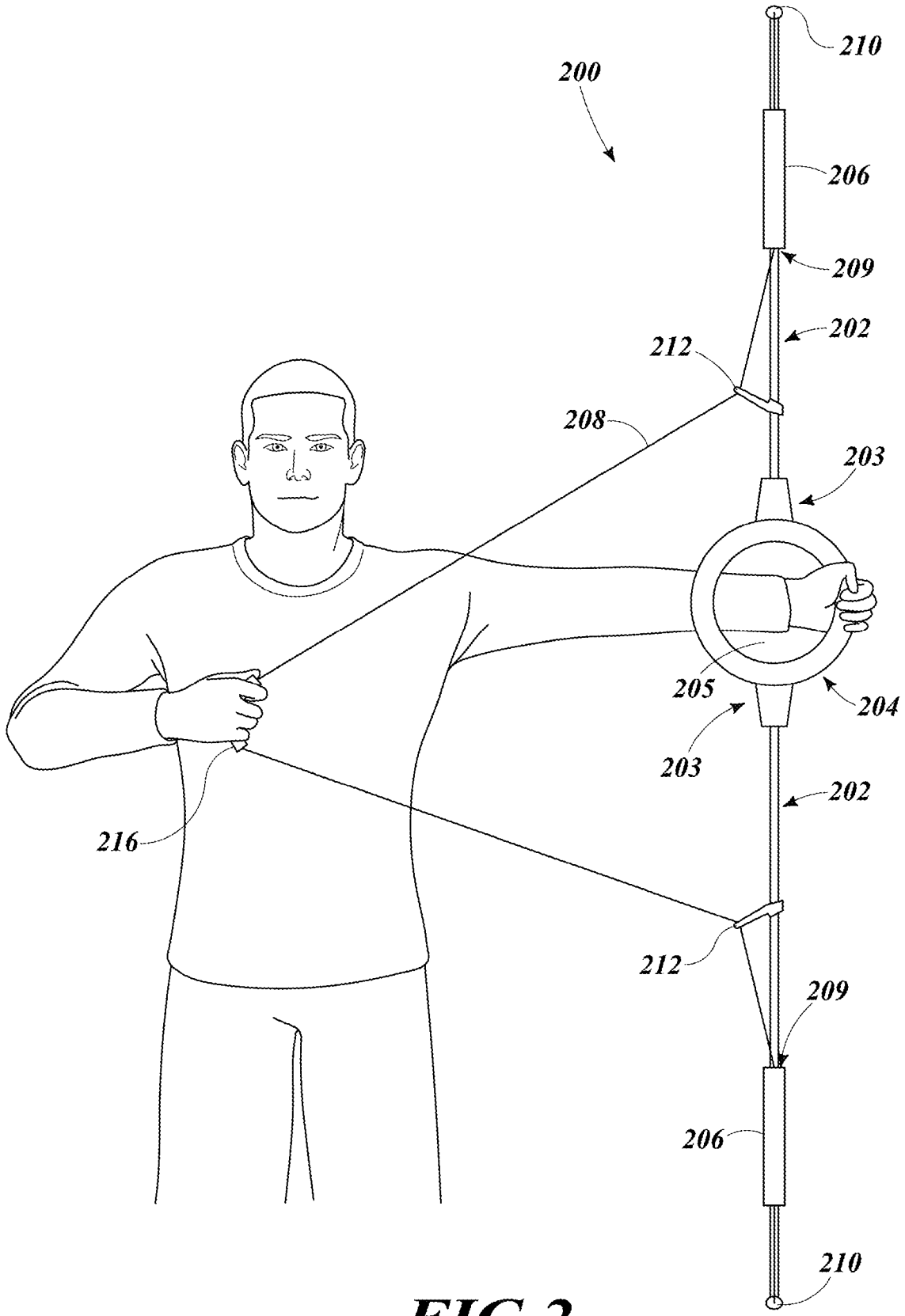
FIG. 2 depicts a person using an elastic resistance device according to one or more embodiments disclosed herein.

FIG. 2 shows a user exercising with an elastic fitness device 200. The elastic fitness device 200 is similar to the elastic fitness device 100 in that it includes two rods 202 that extend from, and are coupled to, a central handle 204 and an elastic member 208 that is coupled via a respective coupling 210 to respective ends of each rod 202. The rods 202 are coupled to the central handle 204 via couplings 203.

Each end of the elastic member 208 is coupled to a respective end of the rods 202 of the elastic fitness device 200. The elastic fitness device 200 also includes a handle 216 on the elastic member 208.

The elastic fitness device 200 also includes a handle 206 on each rod 202. The handles 206 are positionable along the length of each respective rod 202 such that they may be positioned at one or more locations between the end of a respective rod 202 and a coupling 203 that couples each rod 202 to the central handle 204. Unlike the handles 106 of FIG. 1, which include a lock 107 and a resistance adjuster 112, the handles 206 shown in FIG. 2 include neither of these features. Although the handles 206 are positionable along the length of the respective rods 202, the handles 206 are held in place by friction between each handle 206 and its respective rod 202.

In addition, resistance adjusters 212 are not integral with the handles, instead they are separately positionable along the length of the rods 202. As with the resistance adjuster 112 of the embodiment shown in FIG. 1, the resistance adjuster 212 shown in FIG. 2 is used to adjust the resistance provided by the elastic member 208.

The handles 206 also include a central aperture 209 through which the elastic member 208 is routed. In some embodiments, the handles 206 may include a channel in the internal surface of the central aperture 209 of the handle 206.

The user in FIG. 2 is demonstrating one possible exercise for which an elastic fitness device 200 may be used. In this example, the user grips the central handle 204 with the left hand and the handle 216 with the right hand and pulls the handle 216, stretching the elastic member 208.

Figure 3:
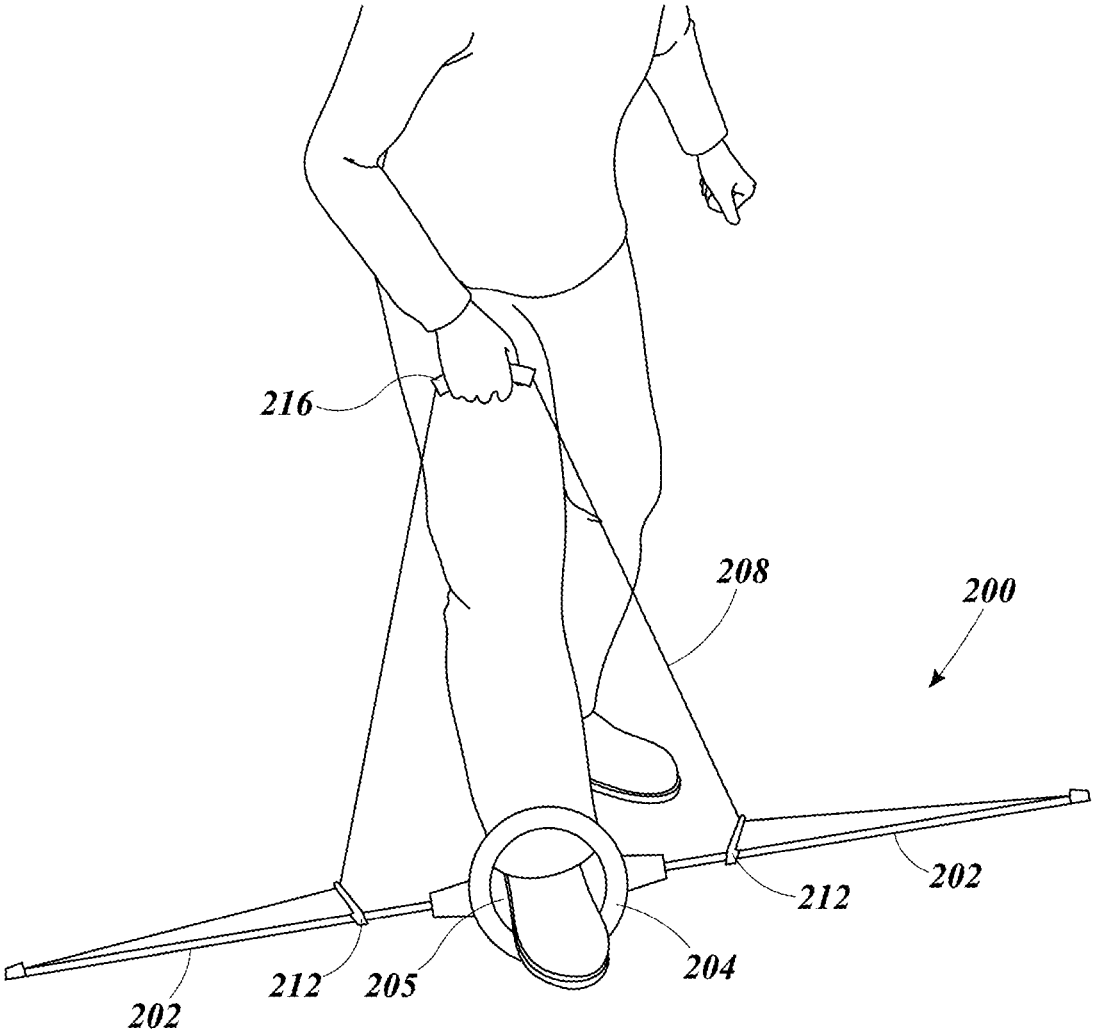
FIG. 3 depicts an alternate use of the elastic resistance device of FIG. 2 according to one or more embodiments disclosed herein.

FIG. 3 shows a user demonstrating another possible exercise for which an elastic fitness device 200 may be used. In this example, the user holds the elastic fitness device 200 against the floor by placing a foot through an aperture 205 of the handle 204 and stepping on the body of the central handle 204. The user can then pull up on the handle 216 and elastic member 208 with one or both hands.

FIG. 3 also shows the elastic fitness device 200 with the resistance adjusters 212 in a position near the central handle 204, providing increased resistance. As is also shown in FIG. 3, the handles 206 may be removable from the rods 202.

Figure 4:
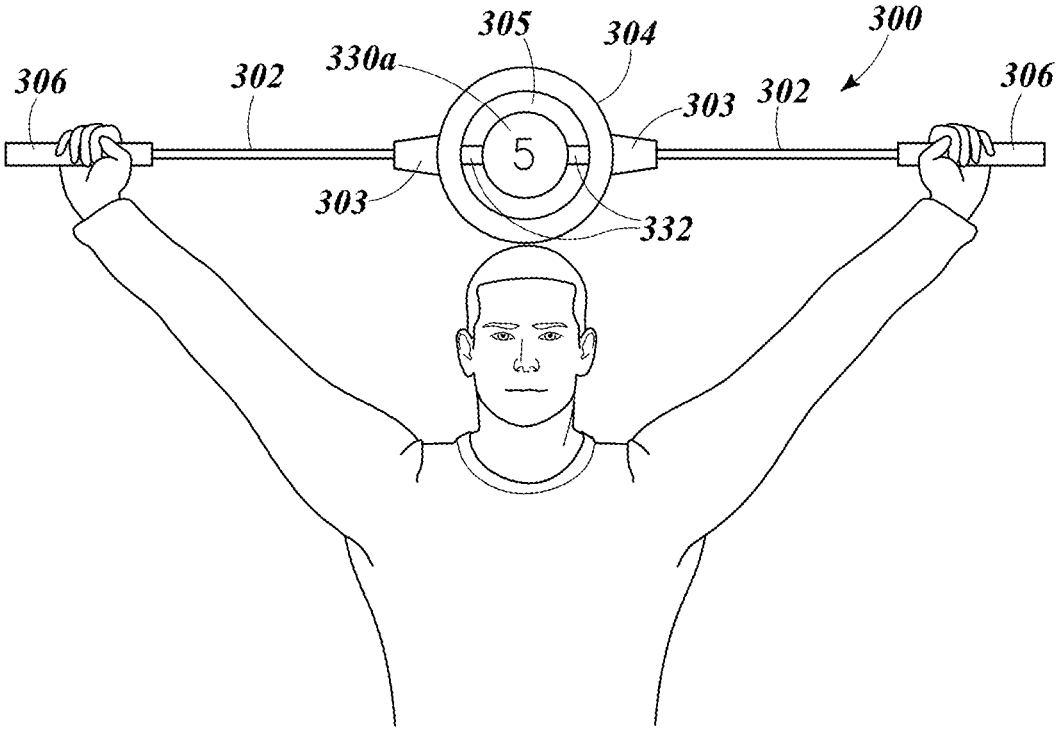
FIG. 4 depicts a person using an elastic resistance device according to one or more embodiments disclosed herein.

FIG. 4 shows an embodiment of an elastic fitness device 300. The elastic fitness device 300 is similar to the elastic fitness device 100 of FIG. 1 in that it includes two rods 302 that extend from, and are coupled to, a central handle 304. The elastic fitness device 300 may include an elastic member that can be coupled the respective ends of each rod 302, but as depicted in FIG. 3, the elastic member is removed so that the user may use the elastic fitness device as a barbell.

The elastic fitness device 300 also includes a handle 306 on each rod 302. The handles 306 are positionable along the length of each respective rod 302 such that they may be positioned at one or more locations between the end of a respective rod 302 and a respective coupling 303 that couples each rod 302 to the central handle 304. Unlike the handles 106 of the embodiment of FIG. 1, which include a lock 107 and an resistance adjuster 112, the handles 306 of FIG. 4 include neither of these features. Although the handles 306 are positionable along the length of the respective rods 302, the handles 306 are held in place by friction between each handle 306 and its respective rod 302, similar to the handles 206 described above with respect to the example embodiment shown in FIG. 2.

In addition, the elastic fitness device 300 has also had its resistance adjusters removed.

The elastic fitness device 300 includes an interchangeable weight such as a five-pound interchangeable weight 330*a*. The interchangeable weight 330*a* is coupled to the elastic fitness device 300 within a central aperture 305 of the central handle 304. The elastic fitness device 300 includes couplings 332 that couple the interchangeable weight to elastic fitness device 300. The couplings 332 may be integral with, or affixed to, the interchangeable weight 330*a*. In some embodiments, the couplings may be affixed to, or integral with, the central handle 304.

Figure 5:
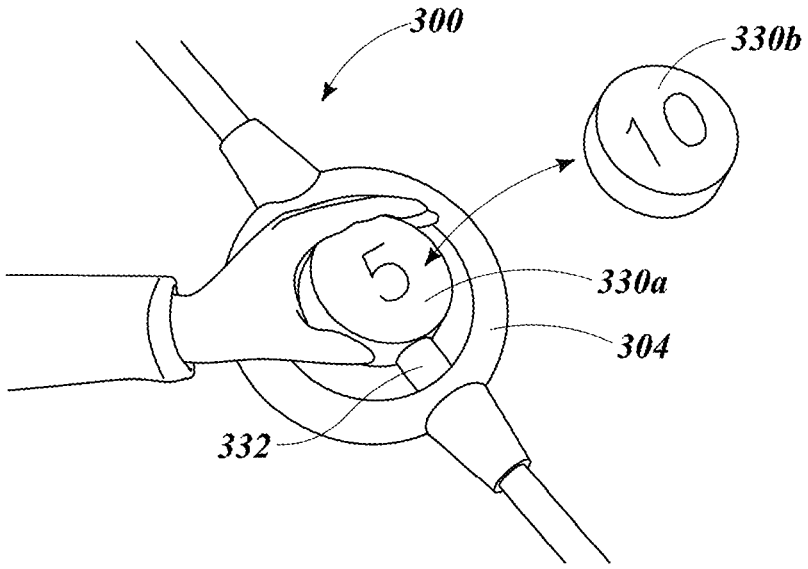
FIG. 5 depicts the interchangeable weights of the elastic resistance device of FIG. 4 according to one or more embodiments disclosed herein.

FIG. 5 shows an embodiment of the five-pound interchangeable weight 330*a* being swapped for a ten-pound interchangeable weight 330*b*. Although only five and ten pound weights are shown, other weights may be used with the elastic fitness device 300.

Figure 6:
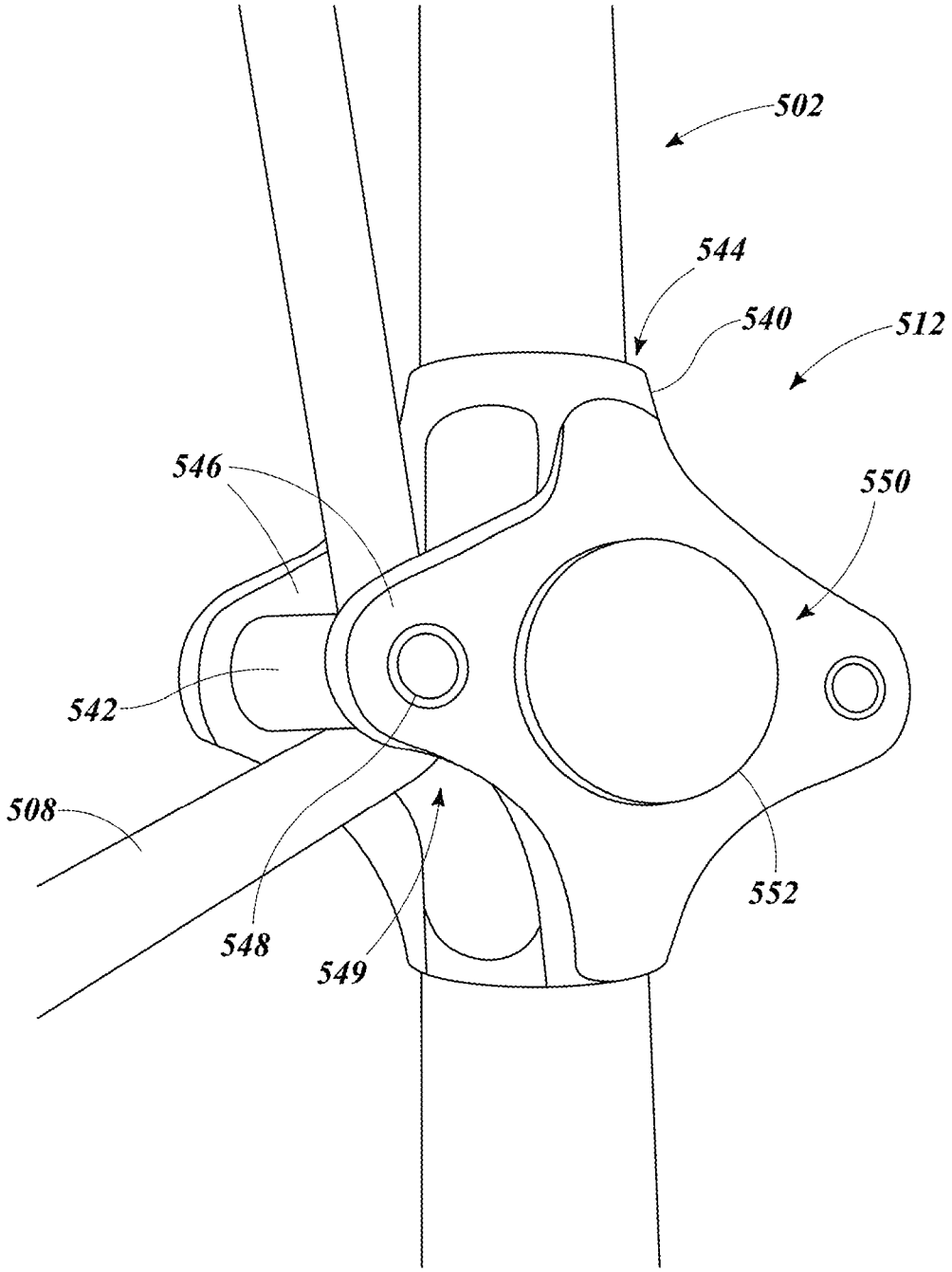
FIG. 6 depicts a resistance adjuster according to one or more embodiments disclosed herein.

FIG. 6 shows an embodiment of a resistance adjuster 512 mounted on a rod 502. The resistance adjuster 512 includes a body 540 including an aperture 544, through which the rod 502 passes. The body 540 of the resistance adjuster 512 slides along the length of the rod 502 and is held in place by a clamp mechanism 550 that, when engaged, holds the resistance adjuster 512 in place on the rod 502 by applying a clamping force to the rod 502. The clamping mechanism includes a push button 552 that when depressed releases the clamping force on the rod 502 and allows the resistance adjuster 512 to slide along the rod 502.

The resistance adjuster 512 also includes a pulley 542 mounted between two extensions 546 on, for example, a shaft 548. The pulley 542, along with the body 540 and the extensions 546, forms an aperture 549 through which an elastic member 508 passes. The pulley 542 acts to reduce the sliding resistance of the elastic member 508 as is move through the aperture 549.

Figure 7:
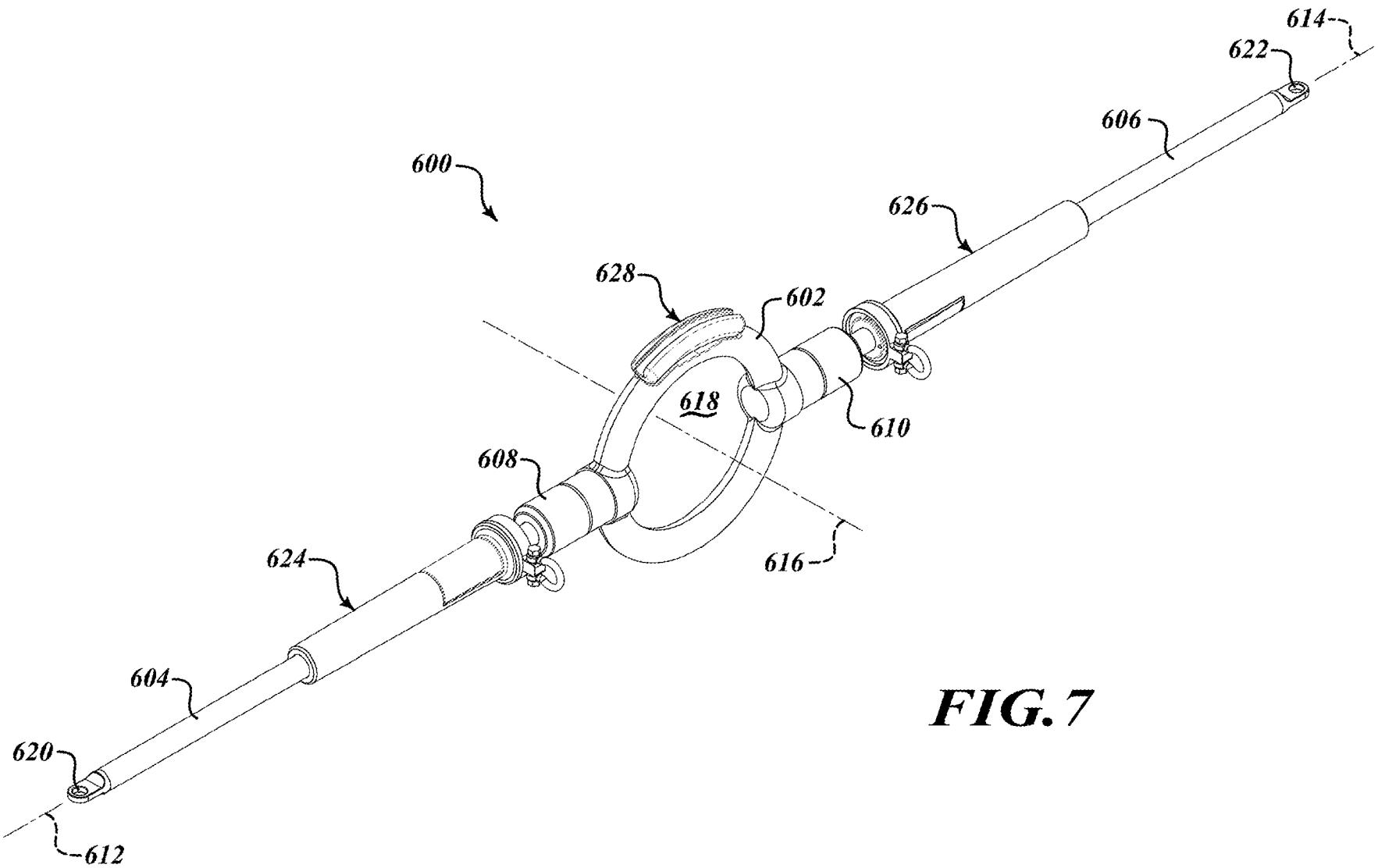
FIG. 7 depicts a modular elastic resistance device according to one or more embodiments disclosed herein.

FIG. 7 illustrates a modular elastic fitness device 600 that is similar to the elastic fitness devices 100, 200, and 300, and that can include any of the features described above for the elastic fitness devices 100, 200, and 300. The elastic fitness device 600 includes a central, ring-shaped handle 602, a first rod 604 coupled to the handle 602, and a second rod 606 coupled to the handle 602. The first rod 604 is removably coupled to the handle 602 at a first coupling 608, which can be a collet-based coupling, and extends radially away from the handle 602 in a first direction. The second rod 606 is removably coupled to the handle 602 at a second coupling 610 located opposite to the first coupling 608 across a diameter of the handle 602, which can be a collet-based coupling, and extends radially away from the handle 602 in a second direction opposite to the first direction.

The first rod 604 and the first coupling 608 have a common first central longitudinal axis 612 and the second rod 606 and the second coupling 610 have a common second central longitudinal axis 614 that is coincident with the first central longitudinal axis 612. The handle 602 forms a ring having an aperture 618 at its center, with a central longitudinal axis 616 of the ring and its aperture 618 extending perpendicularly to the first and second central longitudinal axes 612, 614 of the first and second rods 604, 606. The handle 602 and its aperture 618 are sized so that a user can grasp the handle 602 by putting their fingers, a hand, or an arm through its aperture 618.

As used herein, the terms "proximal" and "distal" refer to relative locations wherein "proximal" refers to a location nearer to a center of the elastic fitness device 600 along the first and second central longitudinal axes 612 and 614, and "distal" refers to a location farther from the center of the elastic fitness device 600 along the axes 612 and 614. For example, the first rod 604 is coupled at its proximal end to the handle 602 at the first coupling 608 and the second rod 606 is coupled at its proximal end to the handle 602 at the second coupling 610.

The first rod 604 includes a coupling such as a ring, eyelet, or aperture 620 at its distal end, to which a first end of an elastic member can be coupled. The second rod 606 includes a coupling such as a ring, eyelet, or aperture 622 at its distal end, to which a second end of the elastic member can be coupled. The first rod 604 can have a first adjustable handle 624 mounted thereon, the second rod 606 can have a second adjustable handle 626 mounted thereon, and the handle 602 can have an elastic member handle 628 mounted thereon. The first and second couplings 608, 610 can be structurally identical to one another, the first and second rods 604, 606 can be structurally identical to one another, and the first and second adjustable handles 624, 626 can be structurally identical to one another.

Figure 8:
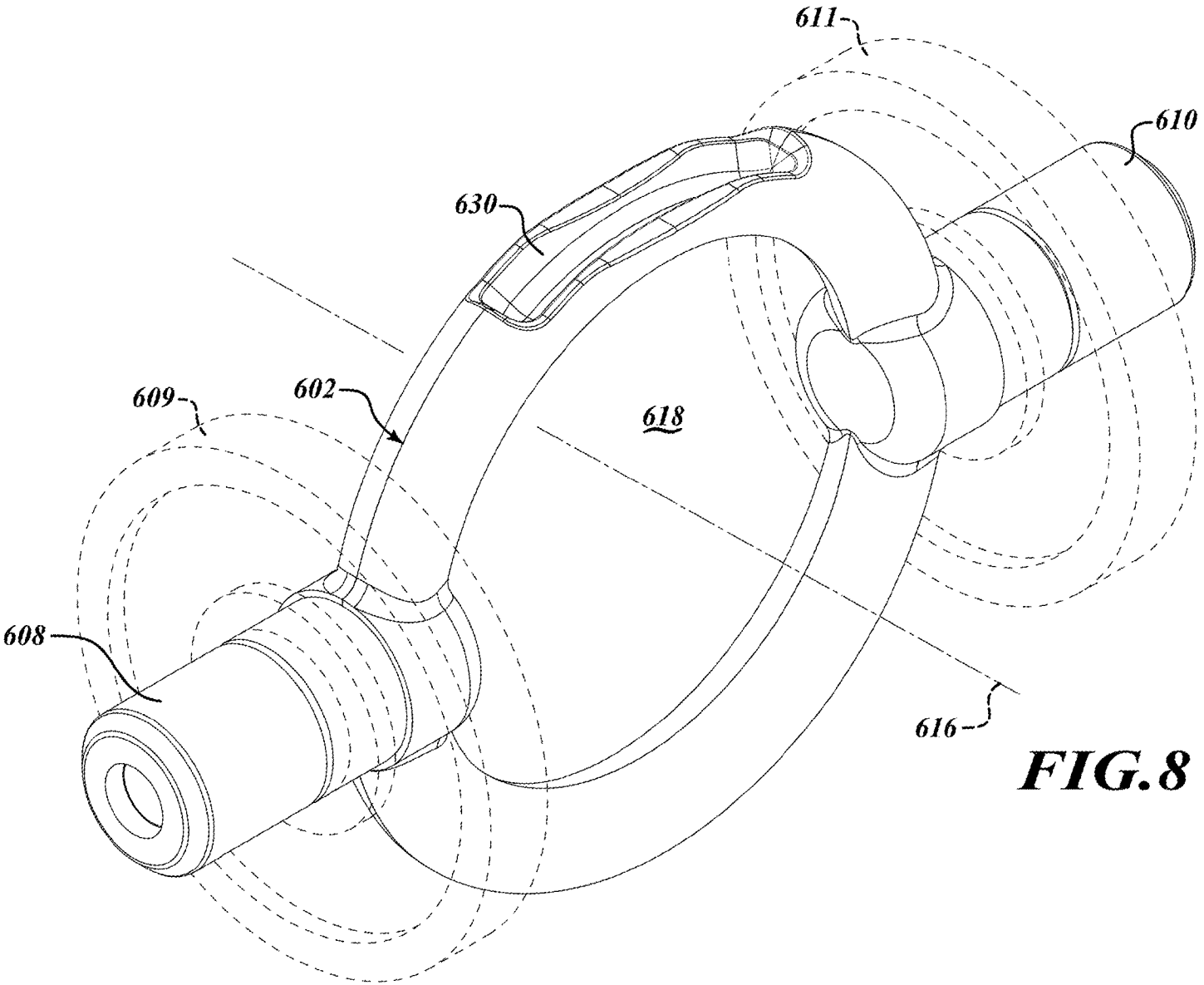
FIG. 8 depicts a portion of the elastic resistance device of FIG. 7, wherein the elastic resistance device is in a kettlebell configuration, according to one or more embodiments disclosed herein.

FIG. 8 illustrates that the device 600 can be disassembled to leave the central handle 602 and the first and second couplings 608 and 610, which can be referred to as a "kettlebell" configuration. The first and second couplings 608 and 610 can have dimensions matching standard barbell ends or Olympic barbell sleeves, so that standard-sized or Olympic-sized plate weights 609 and 611 can be loaded onto the first and second couplings 608, 610 so that a user can use the device 600 in the kettlebell configuration as though it were a kettlebell or a dumbbell. For example, the first and second couplings 608 and 610 can have cylindrical outer surfaces with outer diameters of about 4.95 cm or about 5.00 cm to replicate the ends or sleeves of an Olympic bar.

Figure 9:
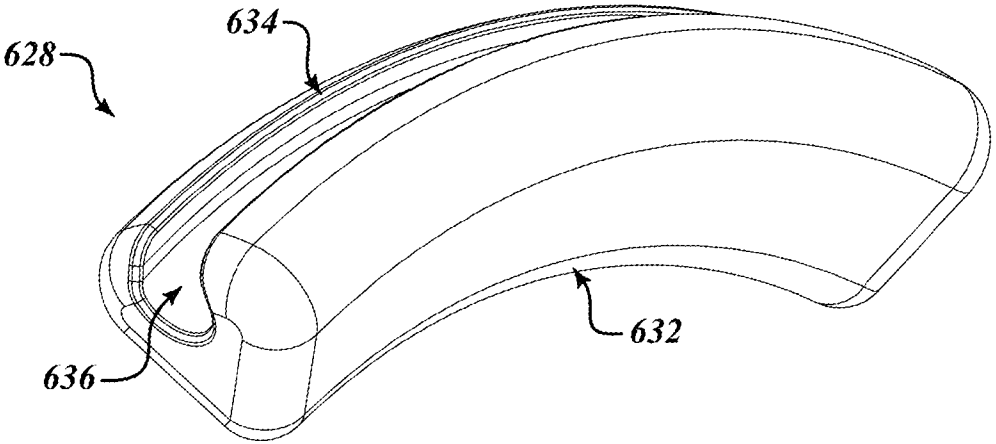
FIG. 9 depicts an elastic member handle of the elastic resistance device of FIG. 7, according to one or more embodiments disclosed herein.

FIG. 8 also illustrates that an outer surface of the handle 602 includes an indentation or a recess 630, which can be sized and dimensioned to receive or cradle the elastic member handle 628. FIG. 9 illustrates the elastic member handle 628 at a larger scale. As illustrated in FIG. 9, the elastic member handle 628 has a curved or arcuate shape with a radius of curvature matching the radius of curvature of the handle 602, so that an inner surface 632 of the elastic member handle 628 (i.e., with respect to the curvature of the elastic member handle 628), can be received or cradled within the recess 630. FIG. 9 also illustrates that an outer surface 634 of the elastic member handle 628 (i.e., with respect to the curvature of the elastic member handle 628) includes a slot or groove 636 sized to receive an elastic member (see, e.g., reference numeral 108 in FIG. 1).

Figure 10:
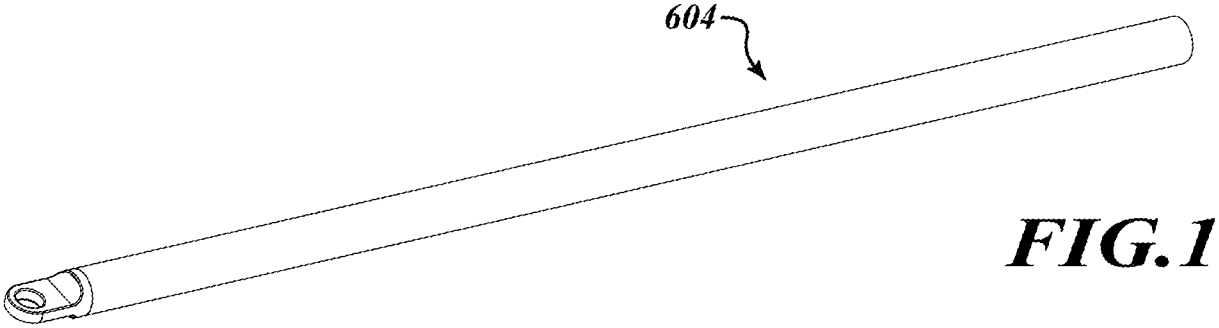
FIG. 10 depicts a rod of the elastic resistance device of FIG. 7, according to one or more embodiments disclosed herein.
Figure 11:
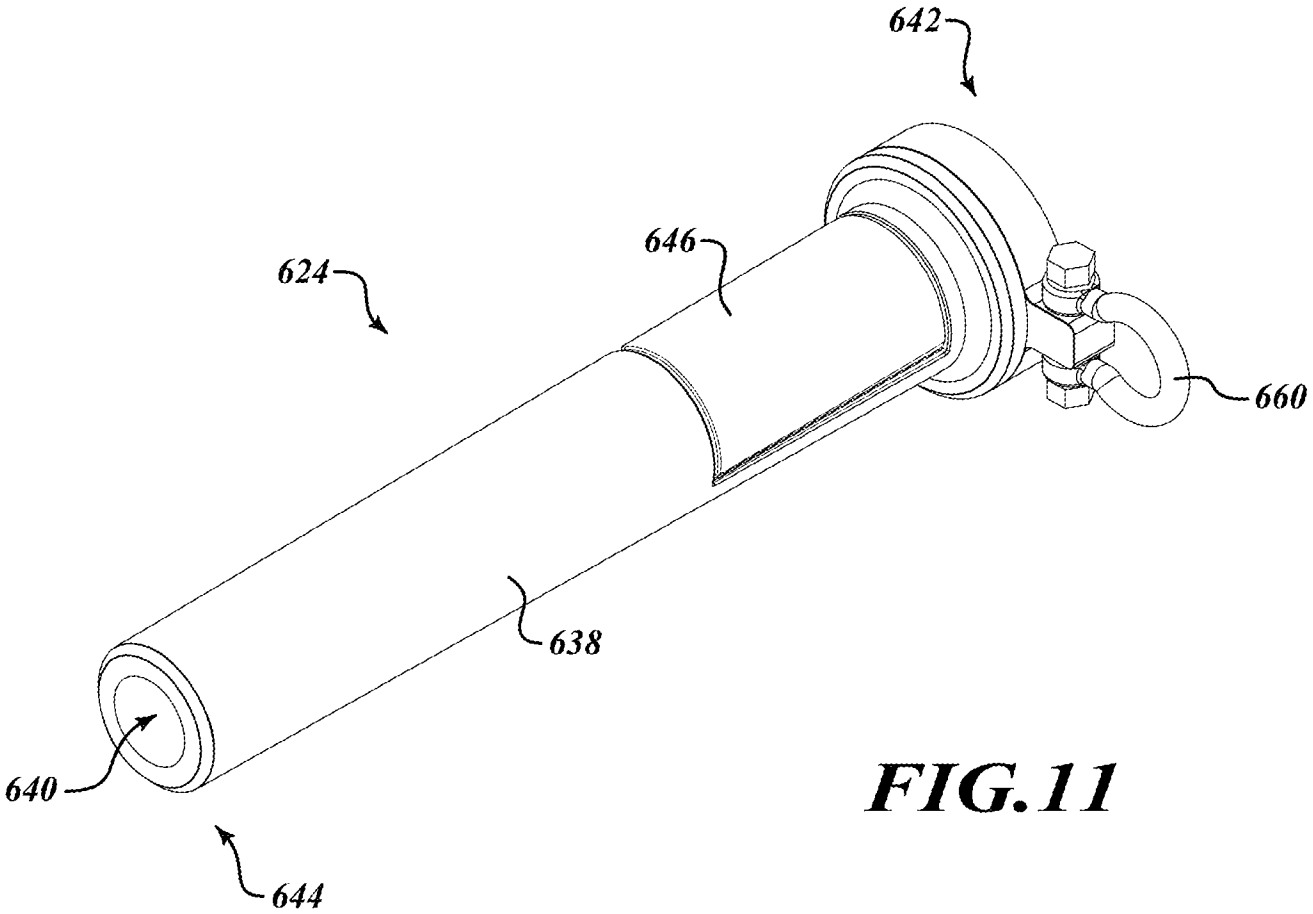
FIG. 11 depicts an adjustable handle of the elastic resistance device of FIG. 7, according to one or more embodiments disclosed herein.

FIG. 10 illustrates the first rod 604 separated from the rest of the device 600 and at a larger scale. FIG. 11 illustrates the first handle 624 separated from the rest of the device 600 and at a larger scale. As illustrated in FIG. 11, the handle 624 includes a cylindrical hollow body 638 that has a cylindrical conduit 640 extending from a proximal end 642 of the handle 624 to a distal end 644 of the handle 624. The cylindrical conduit 640 is dimensioned so that the first rod 604 can extend therethrough and fit smoothly therein. The handle 624 also includes a shackle 660 coupled to the proximal end 642 of the handle 624. The shackle 660 is dimensioned so that an elastic member can pass through its opening. In some embodiments, a pulley or sheave can be coupled to the shackle 660 and the elastic member can pass through the shackle 660 and over the pulley or sheave, to reduce friction between the elastic member and the rest of the device 600 as the elastic member passes through the shackle 660. The handle 624 also includes a lever or clip 646 coupled to the cylindrical hollow body 638.

Figure 12:
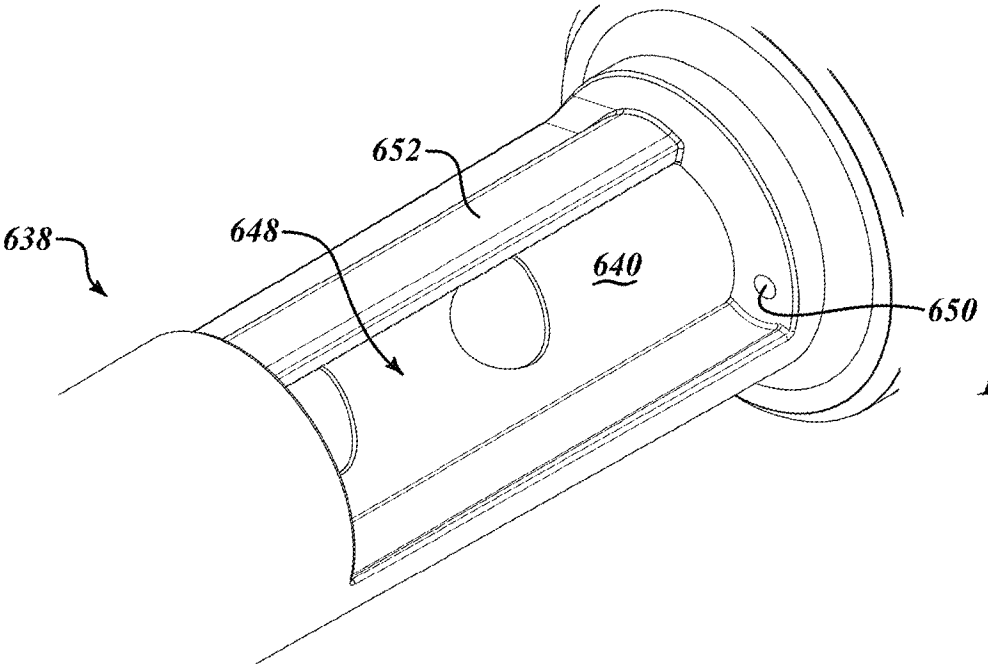
FIG. 12 depicts a larger view of a portion of the adjustable handle depicted in FIG. 11, according to one or more embodiments disclosed herein.

FIG. 12 illustrates a portion of the cylindrical hollow body 638 with the clip 646 removed and at a larger scale. As illustrated in FIG. 12, the cylindrical hollow body 638 can have an opening 648 in its side wall at a location adjacent to the shackle 660 and near the proximal end 642 of the handle 624. The opening 648 can extend partially around the circumference of the handle 624, such as between 90 degrees and 180 degrees around the circumference of the handle 624. A first circumferential end of the opening 648 can include bearings 650 for rotatably mounting the clip 646 to the cylindrical hollow body 638. A second circumferential end of the opening 648 opposite to the first circumferential end can include a partial wall 652 that extends from an inner surface of the hollow body 638 partially outward through the thickness of the hollow body 638. The partial wall 652 allows the clip 646 to rotate partially into the opening 648 and halts rotation of the clip 646 into the opening 648, to leave the handle 624 with a flush outer surface when the clip 646 is rotatable to abut against the partial wall 652.

Figure 13:
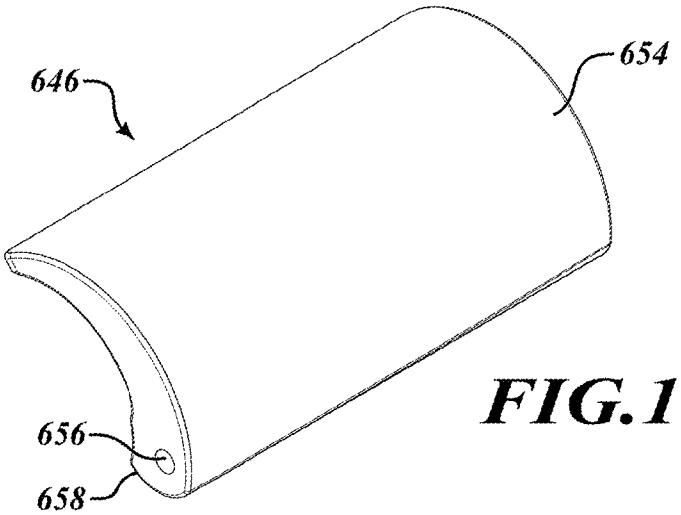
FIG. 13 depicts a larger view of a portion of the adjustable handle depicted in FIG. 11, according to one or more embodiments disclosed herein.

FIG. 13 illustrates the clip 646 separated from the rest of the device 600 and at a larger scale. As illustrated in FIG. 13, the clip 646 can have an arcuate or curved shape with an outer surface 654 curved to match a curvature of the outer surface of the cylindrical hollow body 638. A first circumferential end of the clip 646 includes bearings 656 that can be coupled to the bearings 650 to allow the clip 646 to rotate with respect to the cylindrical hollow body 638. An outer profile 658 of the first end of the clip 646 can form a cam so that as the clip 646 is rotated with respect to the cylindrical hollow body 638, the clip 646 engages with the first rod 604 when it is positioned within the conduit 640 to lock the first handle 624 in position with respect to the first rod 604. Thus, the clip 646 can be rotated away from the opening 648 to allow a user to adjust the position of the first handle 624 along the length of the first rod 604, and can be rotated into the opening 648 to allow the user to lock the first handle 624 to the first rod 604.

Although an elastic member is not illustrated in FIGS. 7 through 13, an elastic member such as one of the elastic members 108 and 208 can be coupled to the other components of the device 600 described herein. For example, a first end of an elastic member can be coupled to the aperture 620, a second end of the elastic member opposite to its first end can be coupled to the aperture 622, and the elastic member can extend from its first end, through the shackle 660, through the groove 636 of the elastic member handle 628, through a shackle of the second handle 626, and to its second end.

A method of using the device 600 can include adjusting the positions of the first and second adjustable handles 624 and 626 along the lengths of the first and second rods 604, 606, respectively, to adjust the resistance of the elastic member extending through the shackles 660 of the adjustable handles 624 and 626. A user can then grasp the ring-shaped handle 602 of the device 600 with a first hand, grasp the elastic member handle 628 and the elastic member with a second hand, and pull the elastic member handle 628 away from the ring-shaped handle 602, against the resistance of the elastic member, to exercise.

The user can then halt this form of exercise and remove the first and second rods 604 and 606, the first and second handles 624 and 626, and the elastic member from the ring-shaped handle 602 and the first and second couplings 608 and 610. The user can then position standard or Olympic plate weights on the exterior surfaces of the couplings 608 and 610, and use standard or Olympic clips or collars, such as lock-jaw type or spring-based collars, to secure the plate weights on the couplings 608 and 610. The user can then grasp the ring-shaped handle 602 with a first hand and lift the ring-shaped handle 602, couplings 608 and 610, plate weights, and locking collars, to exercise.

The user can then halt this form of exercise and remove the locking collars and the plate weights from the couplings 608 and 610. The user can then couple the first and second rods 604 and 606, the first and second handles 624 and 626, and the elastic member, to the ring-shaped handle 602 and the first and second couplings 608 and 610. The user can then grasp the ring-shaped handle 602 of the device 600 with a first hand, grasp the elastic member handle 628 and the elastic member with a second hand, and pull the elastic member handle 628 away from the ring-shaped handle 602, against the resistance of the elastic member, to exercise.

Aspects and features of the various embodiments described above can be combined to provide further embodiments. In addition, U.S. patent application Ser. No. 15/157,091 is hereby incorporated herein by reference in its entirety. Aspects of the embodiments can be modified, if necessary to employ concepts of that application to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. An exercise device, comprising:

a ring-shaped handle including:

a first coupling at a first location, the first coupling having a first central longitudinal axis;

a second coupling at a second location opposite to the first location across a diameter of the ring-shaped handle, the second coupling having a second central longitudinal axis coincident with the first central longitudinal axis; and an opening extending through a center of the ring-shaped handle, the opening having a third central longitudinal axis that is perpendicular to the first and second central longitudinal axes;

wherein the exercise device is symmetric about a plane that is perpendicular to the first and second central longitudinal axes and that includes the third central longitudinal axis.

2. The exercise device of claim 1, further comprising:

a first rod, a proximal end of the first rod coupled to the ring-shaped handle at the first coupling; and a second rod, a proximal end of the second rod coupled to the ring-shaped handle at the second coupling.

3. The exercise device of claim 2 wherein the proximal end of the first rod is removably coupled to the ring-shaped handle at the first coupling and the proximal end of the second rod is removably coupled to the ring-shaped handle at the second coupling.

4. The exercise device of claim 1 wherein the ring-shaped handle is configured to be grasped by a human hand extending through the opening at the center of the ring-shaped handle.

5. The exercise device of claim 1, further comprising at least one interchangeable weight.

6. The exercise device of claim 1, further comprising a five-pound interchangeable weight and a ten-pound interchangeable weight.

* * * * *